US005904417A

United States Patent [19]

Hewett

[11] Patent Number: 5,904,417

[45] Date of Patent: May 18, 1999

[54] LIGHT FIXTURE WITH ELLIPTICAL REFLECTOR AND MECHANICAL SHUTTER DIMMER

[75] Inventor: Arthur Hewett, Berkeley Heights, N.J.

[73] Assignee: Buhl Electric, Inc., Fair Lawn, N.J.

[21] Appl. No.: 08/905,899

[22] Filed: Aug. 4, 1997

[51] Int. Cl.[6] ..... F21V 7/00

[52] U.S. Cl. ..... 362/321; 362/268; 362/281; 362/289

[58] Field of Search ..... 362/268, 280, 362/281, 289, 319, 321, 328, 331, 332

[56] References Cited

U.S. PATENT DOCUMENTS

| | | | |
|---|---|---|---|
| 3,851,165 | 11/1974 | Beck et al. | 362/268 |
| 4,462,067 | 7/1984 | Altman | 362/319 |
| 4,519,020 | 5/1985 | Little | 362/281 |
| 4,811,182 | 3/1989 | Solomon | 362/321 |
| 5,590,954 | 1/1997 | Hanson et al. | 362/280 |

OTHER PUBLICATIONS

The Strand Catalog, ISSN 0969–2827.
Desisti Catalog.

*Primary Examiner*—Y My Quach
*Attorney, Agent, or Firm*—Darby & Darby

[57] ABSTRACT

A lighting apparatus includes a discharge arc lamp illumination source, an elliptical reflector completely surrounding the illumination source for collecting and projecting light from the illumination source, a shutter for dimming the amount of light generated by the illumination source and emanating from the lighting apparatus. The shutter is mechanically operable to defined an optical passageway therethrough of variable cross sectional area. The shutter includes a plurality of shutter blades mounted in a movable relationship relative to each other in response to user input. The shutter blades is movable to define the optical passageway of variable cross sectional area to dim the amount of light from the illumination source passing therethrough over the range of from about 0 to 100%.

16 Claims, 4 Drawing Sheets

LIGHT FIXTURE WITH ELLIPTICAL REFLECTOR AND MECHANICAL SHUTTER DIMMER

BACKGROUND OF THE INVENTION

1. Field of the Invention

The present invention relates generally to light fixtures, and more particularly, to a light fixture useful in stage, television, motion picture, architectural lighting and the like, having an elliptical reflector and mechanical shutter to dim the light generated by an illumination source. This arrangement is an improvement over electrically controlled dimmers, enables the use of a discharge arc lamp as the illumination source, and provides for dimming the light produced by the illumination source over the range of from about 0 to 100% without causing any color change in the projected light.

2. Description of the Prior Art

Projection lighting for the media, entertainment and architectural industries is well known in the art and typically used for spot and soft-lighting applications. A common type is known as a fresnel based light unit, which has a basic design incorporating a large, planar filament lamp disposed at the center of a spherical reflector. A fresnel lens is axially displaced from the lamp/reflector combination to direct the light produced by the lamp from the apparatus. The distribution of light is altered by changing the distance between the lamp/reflector combination and the fresnel lens. In operation, the reflector collects light produced by the rear of the lamp and projects it forwardly to the lens. Light incident from the front of the lamp is directly transmitted to the lens, and the resultant cone of light produced is of a relatively wide angle, i.e., approximately 80–90 degrees. The light projected from the unit emanates in a generally spherical pattern. However, since the reflector only covers a relatively small portion of the spherical pattern, a significant amount of the generated available light does not enter the optical system and overall efficiency is reduced.

Typical prior art lighting units employ filament bulbs for the light source. These lamps produce relatively low luminescence, and operate at power levels of around 27 lumens per watt. Thus, a 600 watt lamp will produce a total lumen output of 16,200 lumens. A large filament lamp has a relatively low intensity, but reasonable longevity, on the order of 300 hours. If the filament is small, its intensity is higher. However, such lamps operate at high temperatures which results in a shorter life, typically on the order of around 75 hours. Such filament lamps are also disadvantageous in that they produce high levels of ambient heating. A Halogen bulb produces a very large proportion of heat relative to its total visible light output. Because of such operating conditions, they burn out and require frequent replacement. In addition, large filament lamps which are used in combination with spherical reflectors are not well suited to other reflector shapes, which can provide enhanced performance as described below. In view of this deficiency, it is desirable to use discharge arc lamps as the illumination source. Such lamps typically operate at around 90 lumens per watt, which results in much cooler operating temperatures thereby placing less demand on the air conditioning system for the room in which the lamp is placed. A 180 Watt arc lamp can produce a luminescence of 16,200 lumens. Because arc lamps are very small as compared to filament types, their intensities are higher. Nevertheless, arc lamps have very long operating lives, typically around 10,000–12,000 hours. However, discharge arc lamps may only be dimmed electrically to about 40% of maximum brilliance.

The design of these lighting units is driven by two primary considerations, the ability to dim the lamp over the full operating range of from about 0–100%, and the requirement to center the lamp about the optical center line of the unit. With filament lamps, dimming is facilitated by simply reducing the input voltage to the lamp. Although this is the most common method, it has a disadvantage in that reducing the voltage causes a temperature drop of the filament, which consequently changes the color of the light produced. Incandescent light tends to get redder as voltage is diminished, which is disadvantageous in the intended application of these units.

Lamp centering systems are embodied in various implementations. Some types are simply disposed on the lamp socket on a plate supported by a plurality of screws and springs. Adjustment of the screws is used to rock the lamp into an aligned position relative to the optical centerline. In other systems, an adjuster is employed to axially move the lamp in the reflector, and a clamp is used for vertical and horizontal translation. In general, however, most of these systems are cumbersome in operation and not very accurate.

In view of the state of the prior art, the present invention provides an improved lighting fixture for use in the above-described applications, which employs a specially designed reflector in combination with a mechanical dimming apparatus.

SUMMARY OF THE INVENTION

In accordance with the present invention, it is an object thereof to provide a lighting apparatus which contains a discharge arc lamp in combination with a mechanical dimming apparatus to dim the output of the lamp over the range of from about 0 to 100%, without causing any color changes in the light produced over the dimmed range.

It is another object of the present invention to provide a lighting apparatus having a discharge arc lamp which provides long life using significantly less energy at the same power output.

It is a further object of the present invention to provide a lighting apparatus which has a medium focal length elliptical reflector completely surrounding a portion of the lamp, in combination with a single plano-convex correcting lens to maximize efficiency.

It is yet another object of the present invention to provide a lighting apparatus that utilizes a lens train comprising two lens with a resultant focal length of the lens combination which is less than the shortest focal length of the two individual lenses, which focuses instead of scattering light, and which enables the lighting apparatus to be moved further away from the target location.

It is still another object of the present invention to provide a lighting apparatus having the above-described advantages, which may be easily transformed from a spot light to a soft light by replacing the fresnel lens with a very-wide-angle lens.

In accordance with the above objects and additional objects that will become apparent hereinafter, the present invention provides a lighting apparatus, comprising: an illumination source, in the preferred embodiment, a discharge arc lamp; a reflector surrounding at least a portion of the illumination source for collecting and projecting light from the illumination source; at least one lens disposed with respect to the illumination source and the reflector through which light from the illumination source passes; and a shutter for dimming the amount of light generated by the illumination source and emanating from the lighting apparatus, the shutter being mechanically operable to define an optical passageway therethrough of variable cross sectional area.

In a preferred embodiment, the reflector has an elliptical profile and is disposed with respect to the illumination source such that the reflector completely surrounds the illumination source. A lens train comprises a piano convex lens disposed between the illumination source and the shutter, and a fresnel lens disposed between the shutter and the environment external to the lighting apparatus, the lenses being situated and arranged such that the combined focal length of both of the lenses is less than the shortest focal length of each lens. In one embodiment, the fresnel lens may be replaced with a wide-angle lens to provide soft lighting. The wide-angle lens is associated with an integrating type reflector of conventional construction.

The shutter for dimming the light produced by the illumination source comprises: a plurality of shutter blades; a mounting arrangement for mounting the shutter blades in a movable relationship relative to each other; and a mechanism for moving the shutter blades relative to each other in response to user input, the shutter blades being movable to define the optical passageway of variable cross sectional area. In particular, the mounting arrangement comprises a mounting plate operably associated with the lighting apparatus, the mounting plate defining an aperture therethrough. The shutter mechanism includes a rotatable disk defining a plurality of slots therein, which is axially spaced from the mounting plate.

In a preferred implementation, the shutter has four (4) shutter blades constructed and arranged to dim the amount of light from the illumination source passing therethrough over the range of substantially from about 0 to 100%, each of the shutter blades being defined by an arc sector of a circle and pivotally connected with a first mounting pin to the mounting plate. A second mounting pin extends from each shutter blade and through a respective slot defined in the mounting plate, such that rotation of the disk causes the shutter blades to change the size of the optical passageway.

The many advantages of the invention will become apparent as the detailed description thereof proceeds below with particular reference to the accompanying drawings.

DETAILED DESCRIPTION OF THE PREFERRED EMBODIMENT

Figure 1:
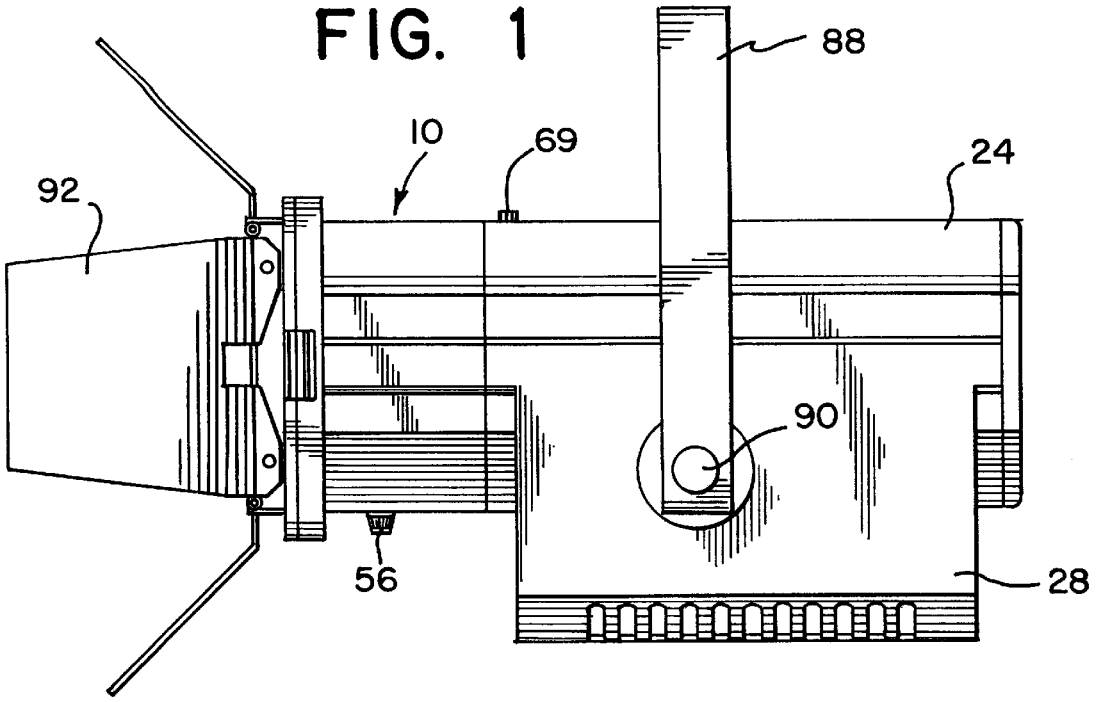
FIG. 1 is a right side elevational view of a light fixture in accordance with the present invention.

With reference now to the several views of the drawings, there is depicted a lighting apparatus generally characterized by the reference numeral 10, comprising an illumination source 12, a reflector 14 completely surrounding at least a portion of illumination source 12 for collecting and projecting light from the illumination source 12, a lens train assembly 16 including at least one lens disposed with respect to illumination source 12 and reflector 14 through which light from illumination source 12 passes, and a shutter assembly 18 for dimming the quantity of light generated by illumination source 12 which is projected from the lighting apparatus 10. A mechanism 20 is provided for adjustably mounting illumination source 12 relative to a back plate 22 of the light fixture housing 24. The illumination source 12, reflector 14 and lens train 16 are axially located with respect to a central axis extending through the lighting apparatus 10. A source of power and associated hardware are shown generally at 26, and disposed in a lower chamber 28 of housing 24.

Figure 2:
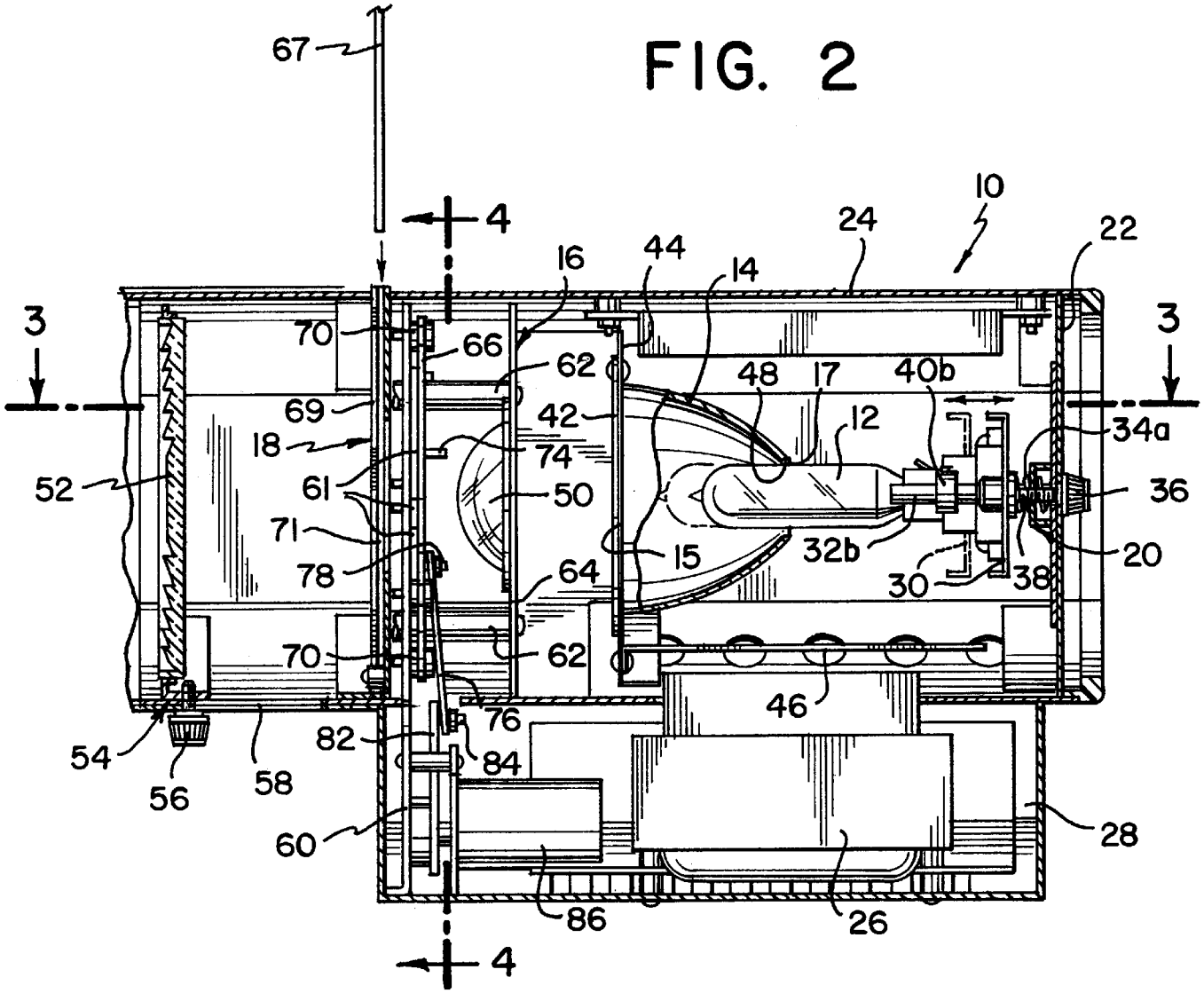
FIG. 2 is a sectional view taken along lines 2—2 in FIG. 3.
Figure 3:
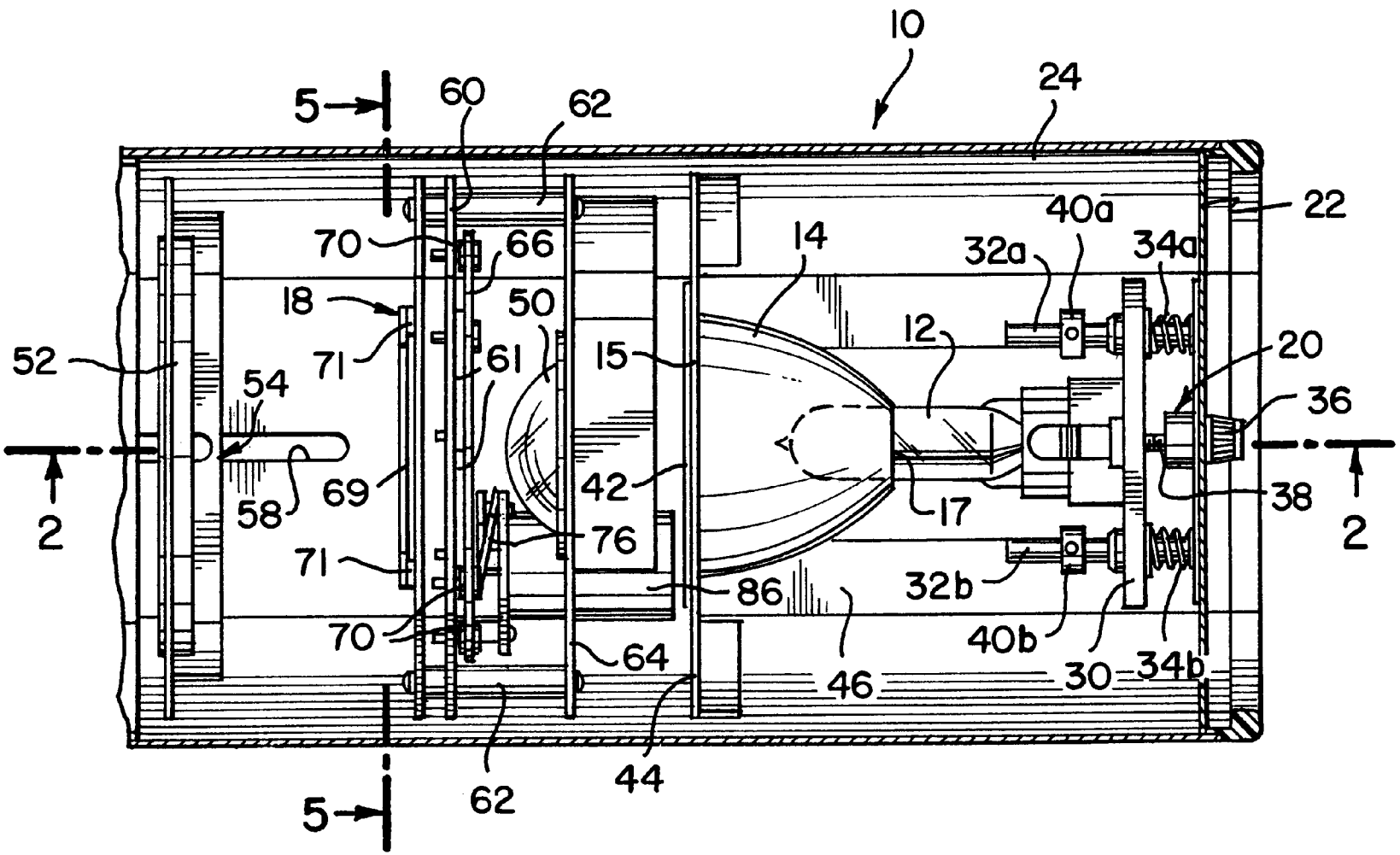
FIG. 3 is a sectional view taken along lines 3—3 in FIG. 2.

The illumination source 12 typically comprises a discharge arc lamp of the type well known in the art (hereinafter "lamp 12"). For example, lamp 12 may be a GE Constant Color CMH™ lamp or a Phillips Mastercolor™ lamp. This lamp 12 is capable of producing a relatively high power output and operates at significantly lower temperatures than comparable filament lamps as discussed in the foregoing. Their compact size makes them better suited for use with non-spherical reflectors. In this connection, the lamp 12 is attached to a floating plate 30 which is slidably mounted on a pair of elongated support rods 32*a*, 32*b* having a pair of springs 34*a*, 34*b*, respectively disposed thereon as shown in FIG. 3. A centrally located twistable knob 36 having a threaded shaft 38 extending therefrom is rigidly affixed to floating plate 30 and enables a portion of lamp 12 to be translated axially within reflector 14 as shown in FIGS. 2 and 3. A pair of stop members 40*a*, 40*b* are affixed to respective support rods 32*a*,32*b*, to limit the rearward longitudinal travel of lamp 12 relative to reflector 14 so that the reflected pattern of light can be optimized with respect to lens train 16.

Reflector 14 is preferably elliptical in shape, which provides a more efficient light collector as compared to the typical spherical arrangement. Reflector 14 is defined by a generally elliptical body having a large open end 15 and a smaller open end 17 defining an aperture 48 sized to enable lamp 12 to be passed therethrough. A flange 42 is defined at large end 15 of reflector 14, and is fastened to a mounting plate 44 to attach reflector 14 to housing 24. To provide sufficient stiffness, a support plate 46 is situated between mounting plate 44 and back plate 22.

In the preferred embodiment, lens train 16 comprises a plano-convex correcting lens 50 and a fresnel lens 52 located respectively on opposite sides of the shutter assembly 18. In particular, the plano-convex correcting lens 50 is placed between lamp 12 and shutter assembly 18, and the fresnel lens 52 is disposed between shutter assembly 18 and the environment external to lighting apparatus 10. The spacing between lenses 50,52 and the shutter assembly 18 is selected such that the combined focal length of both lenses is less than the focal length of each of the lenses 50, 52, respectively. In this manner, a medium focal length reflector 14 can be used with a single plano-convex correcting lens 50 such that the angle of the projected beam is similar to that produced by a spherical system. Thus, the projected light is always focused on the target with minimal scattering, thereby allowing lighting apparatus 10 to be moved further away from the target. For example, instead of a typical distance of 10 feet, a lighting apparatus in accordance with the present invention may be placed as far as 15 to 20 feet away. If necessary to provide soft lighting, the fresnel lens 52 can be removed from the system and a very-wide-angle lens may be substituted in lieu thereof. The very-wide-angle lens (not shown) may have an integrating reflector of the type known in the art. This type of lens provides a more uniform distribution of light, otherwise the beam would have a considerably higher intensity in the center than at the edges. In this manner, an easy conversion can be made between spot and soft lighting. The fresnel lens 52 is mounted on a sliding carriage assembly 54, having an associated knob 56 extending through a slot 58 defined in housing 24, such that lens 52 may be translated axially by simply moving the knob 56 forwardly and rearwardly in a conventional manner.

Figure 4:
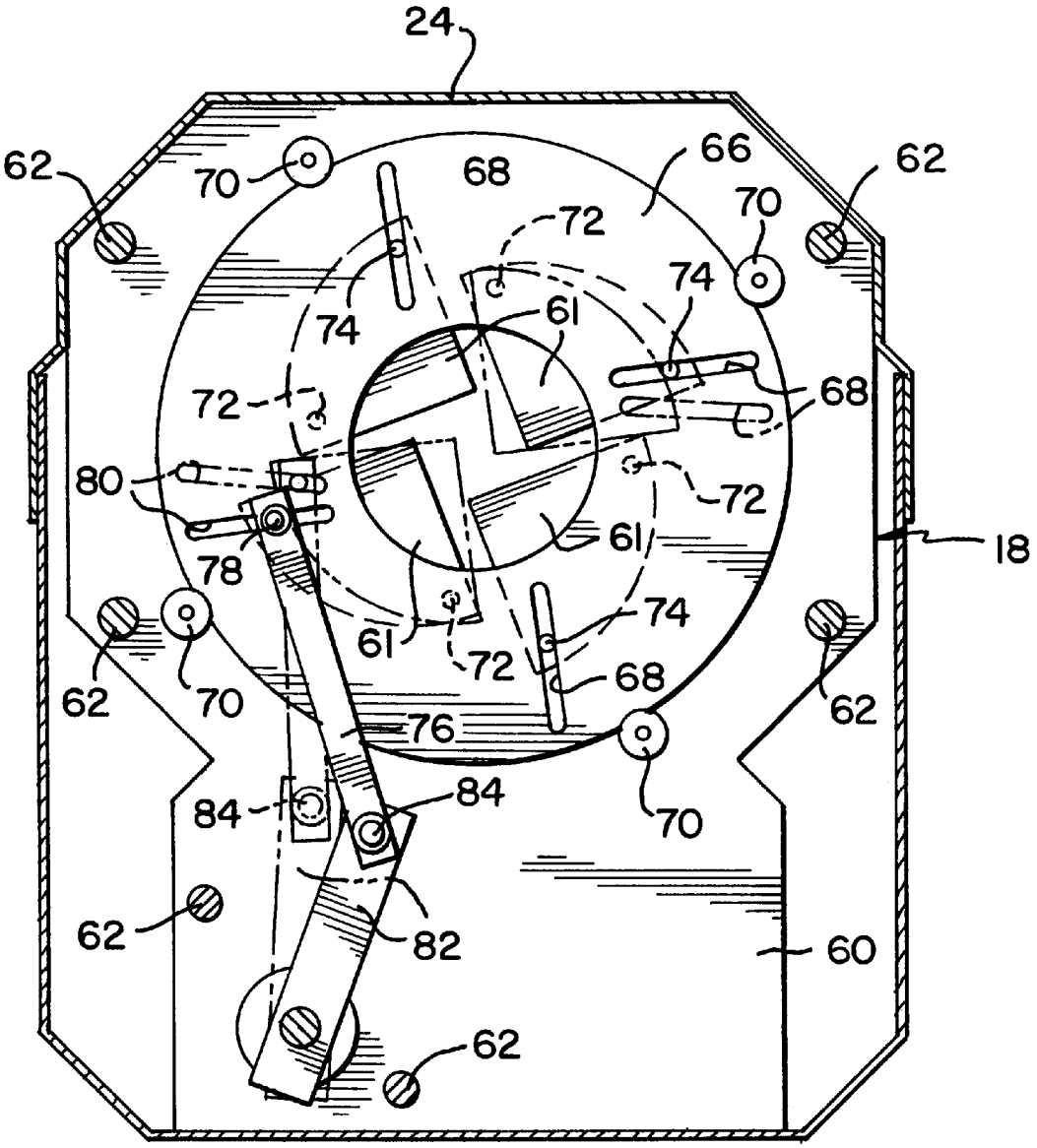
FIG. 4 is a sectional view taken along lines 4—4 in FIG. 2 showing detail of the shutter assembly.

To enable dimming of the light produced by lamp 12, a mechanical shutter assembly 18 comprises, as best seen in FIG. 4, a plurality of shutter blades 61, and a mechanism for mounting shutter blades 61 in a movable relationship relative to each other and for pivoting shutter blades 61 in response to user input so as to define an optical passageway of variable cross-sectional area through which light produced by lamp 12 passes. As shown in FIGS. 2–4, a mounting plate 60 is affixed to housing 24 and defines a central bore therethrough. Mounting plate 60 has a plurality of supports 62 that project rearwardly to support a second mounting plate 64, to which plano-convex correcting lens 50 is attached. A rotatable disk 66 is axially spaced from mounting plate 60 and defines a plurality of guide slots 68 therein as best seen in FIG. 4. The disk 66 is confined by a plurality of rollers 70 operably associated with mounting plate 60 so that disk 66 can rotate in response to user input. Each shutter blade 61 is defined by an arc sector of a circle and pivotally connected with a first mounting pin 72 to mounting plate 60. A second mounting pin 74 located at an opposite corner of the arc segment of shutter blade 61 extends from each shutter blade 61 through a respective slot 68 defined in disk 66. In this manner, rotation of disk 66 causes each shutter blade 61 to rotate about pin 72 with such rotation controlled by the translation of pin 74 in guide slot 68, to enable the operation depicted in FIG. 4, with the phantom representations illustrating the movement of the shutter blade 61 from a first to second location upon rotation of disk 66. This arrangement permits complete closure of the optical passageway such that the light from lamp 12 may be dimmed over the range of substantially from about 0 to 100 percent. Although the illustrative embodiment has four (4) shutter blades 61, it will be apparent to those skilled in the art that other configurations may be used within the scope of the invention.

To enable rotation of disk 66 for shutter control, a linkage mechanism comprises a first link member 76 having a pin 78 which extends through a guide slot 80 defined in disk 66. First link member 76 is pivotally connected to a second link member 82 at pivot 84 as shown. Second link member 82 is driven by a stepper motor 86 which includes an interface responsive to user control in a conventional manner. The system may be coupled to a remote operating unit (not shown) in a manner known to those skilled in the art. By rotating the stepper motor 86 in the appropriate direction, the second link member 82 is driven to cause the first link member 76 to bias pin 78 within slot 80, thereby causing disk 66 to rotate and effectuate shutter operation to the desired illumination level (in the range from about 0 to 100%).

To enable the color of the projected light to be changed as required, a planar glass color or diffusing filter 67 may be inserted against a filter holder plate 69 defining an aperture therethrough. Filter holder plate 69 has filter alignment rails 71 disposed on one side thereof to align filter 67. Filter holder plate 69 is attached to mounting plate 60 by supports 62. Conventional lighting devices used in these applications utilize gelatin color gel to provide for changes in color. Such materials, however, are very heat sensitive and, therefore, in conventional filament bulb lamps, are not long-lasting, typically usable for only 2–3 days. Thus, it is preferable to use a separate dichroic glass color filter 67, although gel filters may also be used in accordance with the present invention. Filter 67 is not typically used in conventional filament lamps because the required relatively large diameter (approximately 6 inches) results in a cost of about $80.00–$90.00 per filter. The structure of the present invention permits the use of smaller diameter filters 67 (approximately 1½ inches), resulting in a cost of about $8.00 per filter (i.e., a 90% cost savings).

Figure 5:
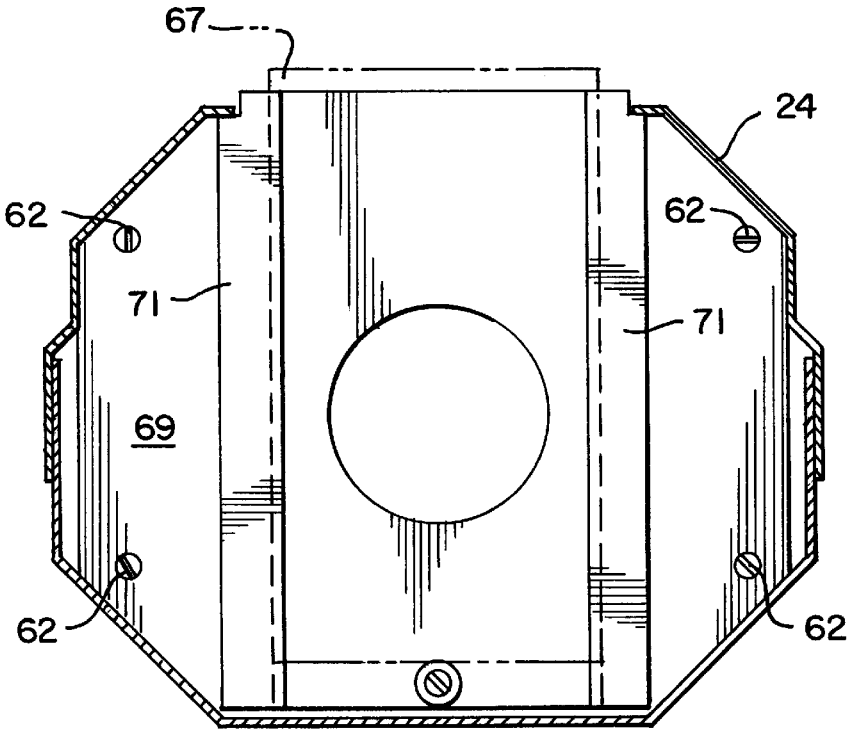
FIG. 5 is a sectional view taken along lines 5—5 in FIG. 3 showing the filter mounting plate.

Referring now to FIGS. 1 and 5, the external arrangement of the lighting apparatus 10 is illustrated. A mounting bracket 88 is pivotally connected to housing 24 at pivot 90 in a conventional fashion. A barn door 92, of the type well known in the art, may be affixed to the front end of housing 24 as shown in FIG. 1 to modify the pattern of light.

The present invention has been shown and described in what is considered to be the most practical and preferred embodiment. It is anticipated, however, that departures made by made therefrom and that obvious modifications will be implemented by persons skilled in the art.

What is claimed is:

1. A lighting apparatus, comprising:

an illumination source;

a reflector surrounding at least a portion of said illumination source for collecting and projecting light from said illumination source;

at least one lens disposed with respect to said illumination source and said reflector through which light from said illumination source passes; and a shutter disposed a fixed distance from said reflector dimming the amount of light generated by said illumination source and emanated from said lighting apparatus over a range of substantially from about 0 to 100%, said shutter mechanically operating to define an optical passageway therethrough of variable cross sectional area, said shutter comprising a plurality of shutter blades mounted in a movable relationship relative to each other and disposed substantially perpendicular to a longitudinal axis passing through said illumination source and said shutter; and means for moving said shutter blades relative to each other in response to user input.

2. The lighting apparatus recited in claim 1, wherein said reflector has an elliptical profile and is disposed with respect to said illumination source such that said reflector completely surrounds said illumination source.

3. The lighting apparatus recited in claim 1, wherein said at least one lens is a fresnel lens.

4. The lighting apparatus recited in claim 1, wherein said at least one lens is a wide-angle lens to provide soft lighting, said wide-angle lens associated with an integrating type reflector.

5. The lighting apparatus recited in claim 1, wherein said illumination source is a discharge arc lamp.

6. The lighting apparatus recited in claim 1, further comprising means for moving said illumination source axially and transversely relative to said reflector.

7. The lighting apparatus recited in claim 1, further comprising a mounting plate operably associated with said lighting apparatus, said mounting plate defining an aperture therethrough;

said means for moving including a rotatable disk axially spaced from said mounting plate, said disk defining a plurality of slots therein; and said shutter further comprising four (4) shutter blades, each of said shutter blades being defined by an arc sector of a circle and pivotally connected with a mounting pin to said mounting plate, and having a second pin extending from said shutter blade and through one of said slots defined in said disk, whereby, rotation of said disk causes said respective shutter blades to change said cross sectional area of said optical passageway.

8. A lighting apparatus, comprising:

an illumination source;

a reflector surrounding at least a portion of said illumination source for collecting and projecting light from said illumination source;

at least one lens disposed with respect to said illumination source and said reflector through which light from said illumination source passes; and a shutter dimming the amount of light generated by said illumination source and emanated from said lighting apparatus, said shutter being mechanically operable to define an optical passageway therethrough of variable cross sectional area;

wherein said at least one lens is a lens train including a plano convex lens disposed between said illumination source and said shutter, said plano convex lens having a focal length, and a fresnel lens disposed between said shutter and the environment external to said lighting apparatus, said fresnel lens having a focal length, said lenses being disposed and arranged such that a combined focal length of both of said lenses is less than the focal length of each of said lenses.

9. A lighting apparatus, comprising:

an illumination source;

an elliptical reflector completely surrounding said illumination source for collecting and projecting light from said illumination source;

a shutter disposed a fixed distance from said reflector dimming the amount of light generated by said illumination source and emanated from said lighting apparatus, said shutter mechanically operating to define an optical passageway therethrough of variable cross sectional area, said shutter including a plurality of movable elements disposed substantially perpendicular to a longitudinal axis passing through said illumination source and said shutter; and a lens train, said lens train comprising at least one lens disposed between said illumination source and said shutter, and at least one lens disposed between said shutter and the environment external to said lighting apparatus.

10. The lighting apparatus recited in claim 9, wherein said illumination source is a discharge arc lamp.

11. The lighting apparatus recited in claim 10, wherein said shutter comprises:

a plurality of shutter blades mounted in a movable relationship relative to each other; and means for moving said shutter blades relative to each other in response to user input, said shutter blades being movable to define said optical passageway of variable cross sectional area.

12. The lighting apparatus recited in claim 11, further comprising a mounting plate operably associated with said lighting apparatus, said mounting plate defining an aperture therethrough;

said means for moving including a rotatable disk axially spaced from said mounting plate, said disk defining a plurality of slots therein; and said shutter further comprising four (4) shutter blades constructed and arranged to dim the amount of light from said illumination source passing therethrough over the range of substantially from about 0 to 100%, each of said shutter blades being defined by an arc sector of a circle and pivotally connected with a mounting pin to said mounting plate, and having a second pin extending from said shutter blade and through one of said slots defined in said disk, whereby, rotation of said disk causes said respective shutter blades to change said cross sectional area of said optical passageway.

13. A lighting apparatus comprising, an illumination source;

an elliptical reflector completely surrounding said illumination source for collecting and projecting light from said illumination source;

a shutter for dimming the amount of light generated by said illumination source and emanated from said lighting apparatus, said shutter being mechanically operable to define an optical passageway therethrough of variable cross sectional area; and a lens train, said lens train comprising at least one lens disposed between said illumination source and said shutter, and at least one lens disposed between said shutter and the environment external to said lighting apparatus, wherein said lens train permits interchangeable use of a fresnel lens, and a wide-angle lens to provide soft lighting.

14. A lighting apparatus, comprising:

an illumination source;

an elliptical reflector completely surrounding said illumination source for collecting and projecting light from said illumination source;

a shutter disposed a fixed distance from said reflector dimming the amount of light generated by said illumination source and emanated from said lighting apparatus, said shutter being mechanically operable to define an optical passageway therethrough of variable cross sectional area, said shutter comprising:

a plurality of shutter blades disposed substantially perpendicular to a longitudinal axis, passing through said illumination source and said shutter, mounted in a movable relationship relative to each other;

means for moving said shutter blades relative to each other in response to user input, said shutter blades being movable to define said optical passageway of variable cross sectional area, said shutter further comprising a mounting plate operably associated with said lighting apparatus, said mounting plate defining an aperture therethrough; said means for moving including a rotatable disk axially spaced from said mounting plate, said disk defining a plurality of slots therein;

said shutter blades constructed and arranged to dim the amount of light from said illumination source passing therethrough over a range of substantially from about 0 to 100%, each of said shutter blades being defined by an arc sector of a circle and pivotally connected with a mounting pin to said mounting plate, and having a second pin extending from said shutter blade and through one of said slots defined in said disk, whereby, rotation of said disk causes said respective shutter blades to change said cross sectional area of said optical passageway; and a lens train comprising at least one lens disposed between said illumination source and said shutter, and at least one lens disposed between said shutter and the environment external to said lighting apparatus.

15. A lighting apparatus, comprising:

a discharge arc lamp illumination source;

an elliptical reflector completely surrounding said illumination source for collecting and projecting light from said illumination source;

a shutter disposed a fixed distance from said reflector dimming the amount of light generated by said illumination source and emanated from said lighting apparatus, said shutter being mechanically operable to define an optical passageway therethrough of variable cross sectional area, said shutter comprising:

a plurality of shutter blades disposed substantially perpendicular to a longitudinal axis, passing through said illumination source and said shutter, mounted in a movable relationship relative to each other;

means for moving said shutter blades relative to each other in response to user input, said shutter blades being movable to define said optical passageway of variable cross sectional area, said shutter further comprising a mounting plate operably associated with said lighting apparatus; said means for moving including a rotatable disk axially spaced from said mounting plate, said disk defining a plurality of slots therein; said shutter further comprising four (4) shutter blades constructed and arranged to dim the amount of light from said illumination source passing therethrough over a range of substantially from about 0 to 100%, each of said shutter blades is defined by an arc sector of a circle and pivotally connected with a mounting pin to said mounting plate, and having a second pin extending from said shutter blade and through one of said slots defined in said disk, whereby, rotation of said disk causes said respective shutter blades to change said cross sectional area of said optical passageway; and a lens train comprising at least one lens disposed between said illumination source and said shutter, and at least one lens disposed between said shutter and the environment external to said lighting apparatus.

16. A lighting apparatus, comprising:

a discharge arc lamp illumination source;

an elliptical reflector surrounding at least a portion of said illumination source for collecting and projecting light from said illumination source;

a plano convex lens disposed adjacent to said illumination source, said plano convex lens having a focal length; and a fresnel lens disposed between said plano convex lens and the environment external to said lighting apparatus, said fresnel lens having a focal length, said lenses being disposed and arranged such that a combined focal length of both of said lenses is less than the focal length of each of said lenses.

* * * * *